United States Patent [19]

Momose et al.

[11] 4,308,425

[45] Dec. 29, 1981

[54] VARIABLE-DIRECTIVITY MICROPHONE DEVICE

[75] Inventors: Chikahide Momose; Atushi Yumoto, both of Yokohama; Naotaka Miyaji, Yamato; Hiroshi Ogawa, Yokohama; Isami Nomoto, Yokohama, all of Japan

[73] Assignee: Victor Company of Japan, Ltd., Yokohama, Japan

[21] Appl. No.: 142,845

[22] Filed: Apr. 22, 1980

[30] Foreign Application Priority Data

Apr. 26, 1979 [JP] Japan ..... 54-51691

[51] Int. Cl.[3] ..... H04R 1/40

[52] U.S. Cl. ..... 179/1 DM

[58] Field of Search ..... 179/1 DM, , 121 D

[56] References Cited

U.S. PATENT DOCUMENTS 2,305,599 12/1942 Bauer ..... 179/121 D 3,403,223 9/1968 Kleis et al. ..... 179/1 DM

*Primary Examiner*—George G. Stellar

*Attorney, Agent, or Firm*—Haseltine and Lake

[57] ABSTRACT

A variable-directivity microphone device comprises at least three microphones. First and second microphones mutually spaced apart by specific distances and facing in the same direction and a third microphone facing in the opposite direction. A directivity varying control capable of undergoing displacement between at least three positions, a first mixer operating, while the control is between a first and a second position, to mix, in accordance with the position thereof, the third microphone signal with the first microphone signal and, while the control is between the second and third positions, to cause the third microphone output signal to be zero, and a second mixer operating, while the control is between the second and third positions, to mix the first and second microphone output signals with varied mixing quantity and, while the control is between the first and second positions, to cause the output signal of the second microphone to be zero. The directivity obtained from the first and third microphone output signals mixed through the first mixer in accordance with the displacement of the control between the first and second positions being varied between a state of non-directivity and a primary sound-pressure gradient unidirectivity. The directivity obtained from the output signals of the first and second microphones mixed through the second mixer in accordance with the displacement of the control between the second and third positions being varied between a primary sound-pressure gradient unidirectivity and a multiple-order sound-pressure gradient unidirectivity.

7 Claims, 13 Drawing Figures

10
11
12
13
14
15
16
17
18
19
20
21
22
23
24
24a
30
31
32
33
35

VARIABLE-DIRECTIVITY MICROPHONE DEVICE

BACKGROUND OF THE INVENTION

The present invention relates generally to variable-directivity microphone devices and more particularly to a variable-directivity microphone device in which at least three unidirective microphone units are combined in a specific arrangement, and the respective output signals of these microphone units are mixed with varied mixing ratios, whereby the directivity is varied widely, and zooming of the acoustic or sound image can be carried out with ample sense of distance change as sensed by the listener.

Heretofore, as a microphone device capable of varying directivity, there has been a microphone device of a constitutional arrangement wherein two unidirective microphones are disposed in opposition, and their outputs are mixed with varied mixing ratio. In this device, a final output signal is obtained by varying the mixing ratio thereby to make possible variation of the directivity of the microphone device, as a resultant effect, from a state of non-directivity, through bidirectivity, up to unidirectivity.

However, in this known microphone device, the range of variation of the directivity is narrow, whereby there is the drawback of insufficient acoustic image zooming effect with ample sense of distance change.

SUMMARY OF THE INVENTION

Accordingly, it is a general object of the present invention to provide a new and useful variable-directivity microphone device in which the above described problem has been overcome.

Another and specific object of the invention is to provide a variable-directivity microphone device in which at least three primary sound-pressure gradient unidirective microphone units are arranged in a specific combination of positional configuration, and the respective outputs of the microphone units are mixed with varied mixing ratios. In the device according to the invention, the directivity can be varied in a vast range from a state of non-directivity, through primary sound-pressure gradient unidirectivity, up to a multiple-order sound-pressure gradient unidirectivity above secondary. Furthermore, zooming of the acoustic image is possible while imparting an ample sense of distance change.

Still another object of the invention is to provide a variable-directivity microphone device which is installed in a camera provided with a zoom lens system and which is so adapted that its directivity is varied as described above in conformance and interrelatedly with the zooming of the zoom lens system.

Other objects and further features of the present invention will be apparent from the following detailed description with respect to preferred embodiments of the invention when read in conjunction with the accompanying drawings.

DETAILED DESCRIPTION

Figures 1A, 1B, 2:
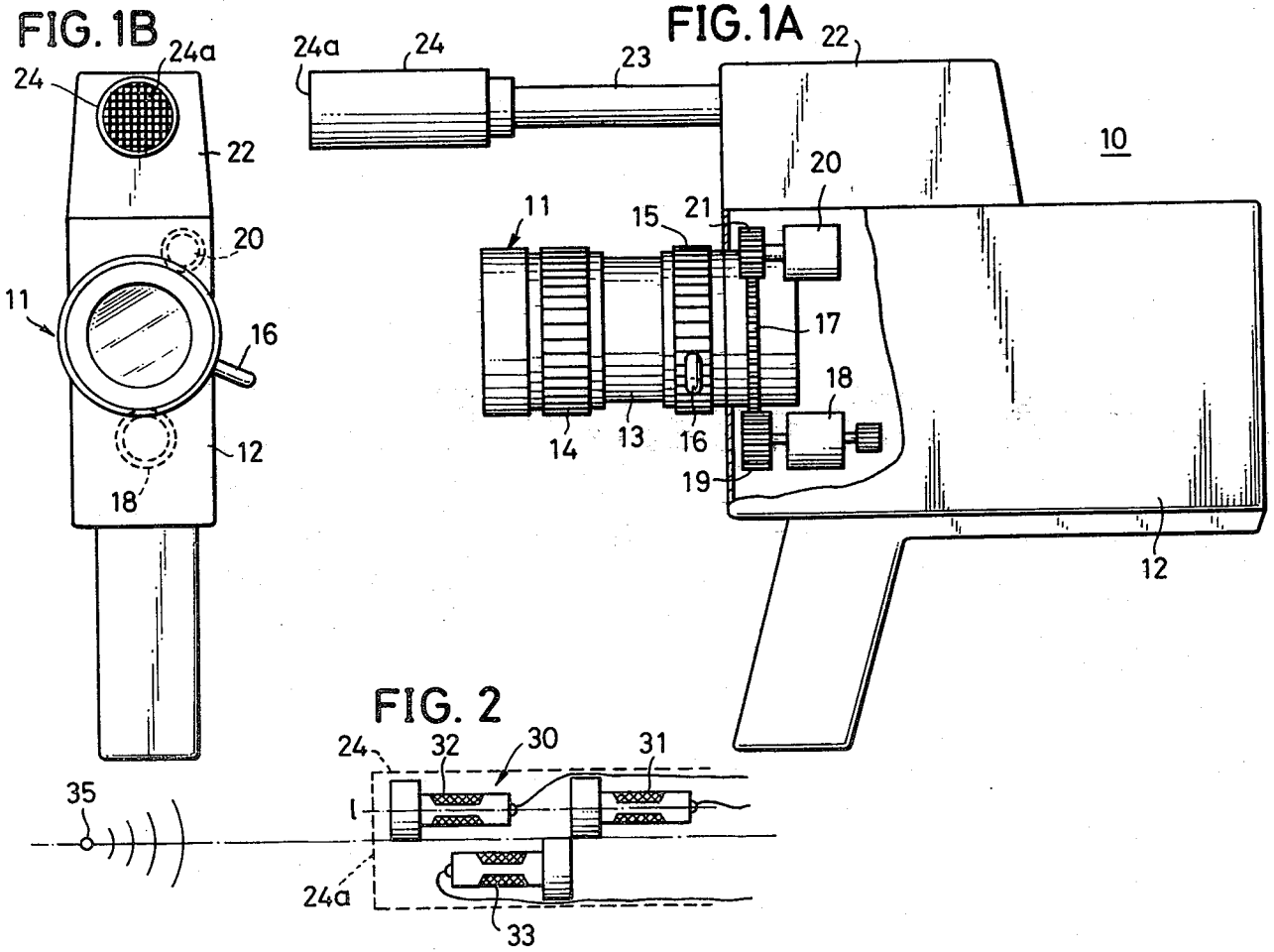
FIGS. 1A and 1B are respectively a side view, with parts cut away, and a front view of one embodiment of a television camera in which the variable-directivity microphone device according to the present invention is applied.
FIG. 2 is a view for a description of the positional arrangement of microphone units in one embodiment of the variable-directivity microphone device according to the invention.

One example of a televisiion camera in which an embodiment of the variable directivity microphone device according to the present invention is applied will first be described in conjunction with FIGS. 1A and 1B.

The television camera 10 has a zoom lens system 11 mounted on the front part of a camera body 12. This zoom lens system 11 comprises a fixed cylinder 13 containing the lens system, a distance matching ring 14, and a zoom ring 15. A zoom operating lever 16 is fixed to the zoom ring 15.

The zoom ring 15 is integrally formed with a rotating cylinder extending rearward into the camera body and supporting, in the camera body, a gear 17 fixed coaxially to the rotating cylinder. Also within the camera body 12, a gear 19 fixedly mounted on the rotor shaft of a drive motor 18 is meshed with the gear 17. A gear 21 fixedly mounted on the rotating shaft of a variable resistor, also accommodated within the camera body 12, is also meshed with the gear 17.

Figure 4:
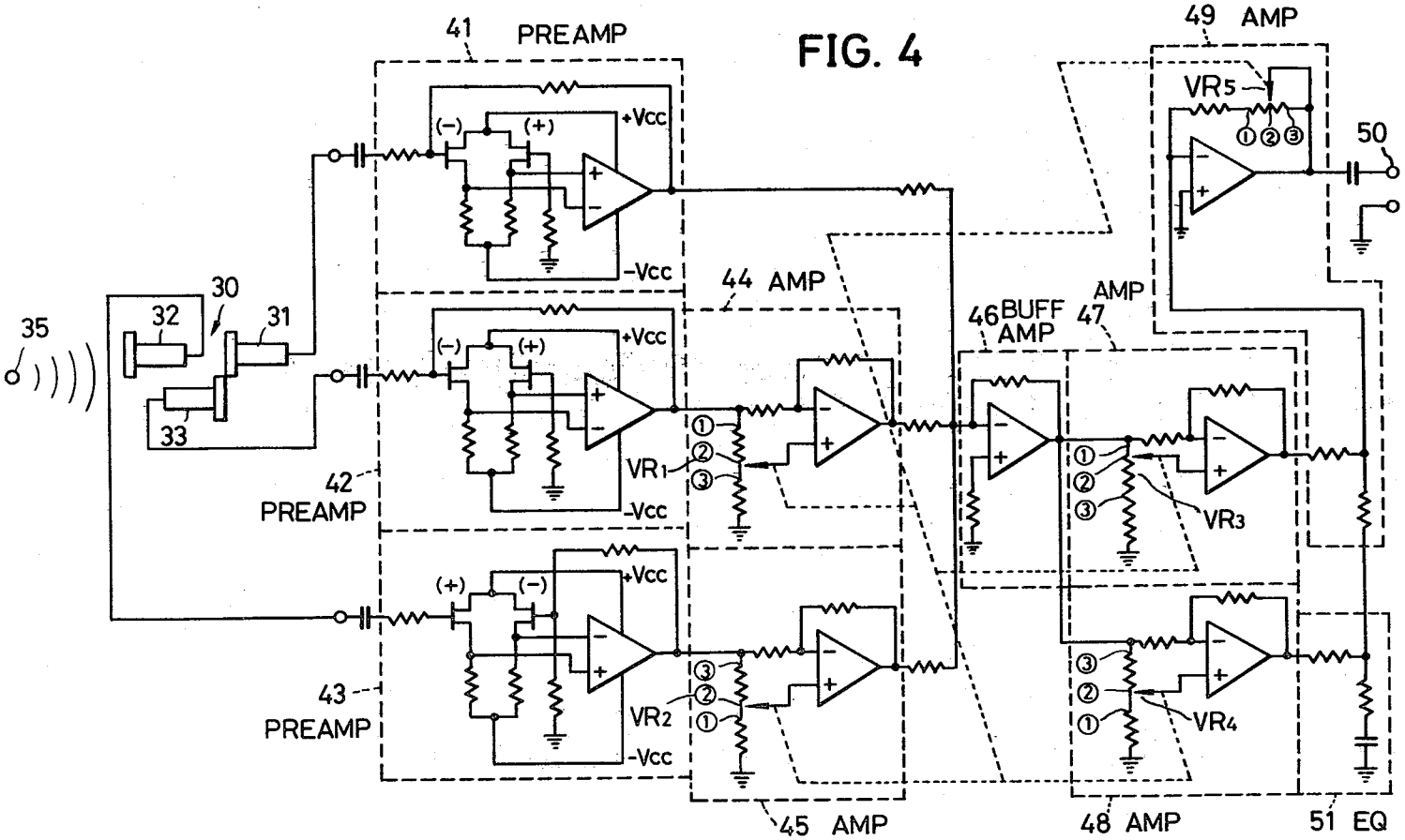
FIG. 4 is a circuit diagram of one embodiment of a circuit according to the invention for mixing with varied mixing ratio the outputs of the microphone units shown in FIG. 2.

A housing 22 accommodating a circuit described hereinafter in conjunction with FIG. 4 is mounted on top of the camera body 12. This housing 22 fixedly supports a rod 23 directed straight forward and supports at its forward end a microphone unit accommodating cylinder 24.

When the zoom lens system is to be operated in zooming operation, the operator holds the lever 16 and directly rotates the zoom ring 15 in the case of manual operation. In the case of automatic operation, a switch is closed to supply electric power to the drive motor 18 and cause it to rotate. This driving rotation is transmitted via the gears 19 and 17 to rotate the zoom ring 15.

Within the microphone unit accommodating cylinder 24 is accommodated a microphone unit set 30 comprising three microphone unit 31, 32, and 33 positionally arrange, for example, as shown in FIG 2. Each of these microphone units 31, 32, and 33 has a primary sound-pressure gradient unidirectivity (hereinafter referred to simply as primary unidirectivity). In the present embodiment of the invention, the microphone units 31 and 32 are so positioned in tandem arrangement that they are directed toward the front face 24*a* of the cylinder 24 with their centerlines coincident with the same line l. The microphone unit 31 is so positioned that its diaphragm is, for example, 3 to 4 cm. to the rear of the diaphragm of the microphone unit 32. On the other hand, the microphone unit 33 is directed rearward, away from the front face 24*a* of the cylinder and is so positioned that its centerline is parallel to but laterally offset from the line l, and, at the same time, its diaphragm lies in the same plane as the diaphragm of the microphone unit 31.

Figure 3:
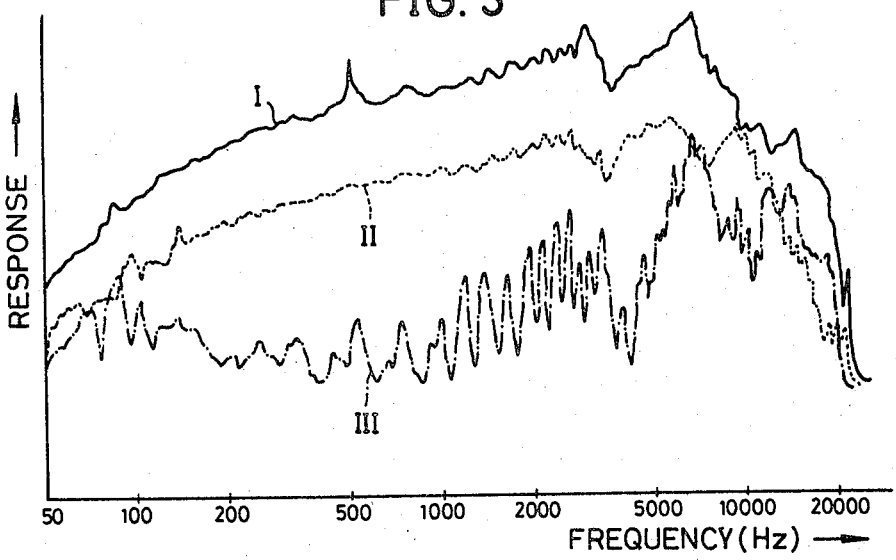
FIG. 3 is a graph with curves respectively indicating the frequency-response characteristics of the individual microphone units shown in FIG. 2.

The frequency-response characteristics respectively of the individual microphone units 31, 32, and 33 are as indicated in FIG. 3. In this graph, the curves I, II, and III indicate the frequency-response characteristics respectively when the angle between the centerline of the front face of the microphone unit and the directional line to the sound source 35 is 0°, 90°, and 180°.

The circuit indicated in FIG. 4 is accommodated within the housing 22. The microphone units 31, 32, and 33 are respectively connected to preamplifiers 41, 43, and 42. The variable resistor 20 in FIG. 1A comprises five ganged variable resistors VRI through VR5 shown in FIG. 4. The sliders respectively of these variable resistors are slidingly displaced in responsive conformance with the rotation of the gear 21 which is driven by the gear 17. The variable resistors VR1 and VR2 are respectively connected between the preamplifiers 42 and 43 and amplifiers 44 and 45. The output sides of the preamplifier 41 and the amplifiers 44 and 45 are connected to a buffer amplifier 46. The variable resistors VR3 and VR4 are respectively connected between the amplifier 46 and amplifiers 47 and 48. The variable resistor VR5 is connected in a feedback circuit of an amplifier 49 connected to the output side of the amplifiers 47 and 48.

Next, the operation wherein the directivity of the microphone device is varied at the time of zooming up of the object being picked up will be described. By manipulating the lever 16 or operating the motor 18, the zoom ring 15 is rotated, and zooming up is carried out. Together with the rotation of the zoom ring 15, the rotating shaft of the variable resistor 20 rotates, and the sliders of the variable resistors VR1 through VR5 undergo sliding desplacement from the positions ① to the positions ② indicated in FIG. 4, for example.

Here, at the time when the sliders of the variable resistors VR1 through VR5 have undergone sliding desplacement respectively from their positions ① to their positions ③ , the resistance values and the gains of the amplifiers 44, 45, 47, 48, and 49 connected to the input sides of these variable resistors vary as indicated by lines I through V in FIGS. 6(A) through 6(E), respectively. In each of these figures, the abscissa represents the sliding displacement position of the slider, and position designations ①, ②, and ③ correspond to the positions ①, ②, and ③ in FIG. 4. The ordinates in each of these figures represent the resistance value of the corresponding variable resistor and the gain of the corresponding amplifier.

Prior to the zooming control operation, the sliders of all variable resistors are at their respective positions ①. The output of the microphone unit 31 directed forwardly relative to the sound source 35 and the output of the microphone unit 33 directed rearwardly relative thereto are respectively amplified in the preamplifiers 41, the preamplifier 42, and the amplifier 44, are thereafter mixed and supplied to the buffer amplifier 46. At this time, as indicated in FIG. 6(A), the resistance value of the variable resistor VR1 is a maximum, (for example, 40 kΩ including fixed resistance 20 kΩ and variable resistance 20 kΩ), and the gain of the amplifier 44 is 1 (unity). On the contrary, as indicated in FIG. 6(B), the resistance value of the variable resistor VR2 is a minimum (20 kΩ), and the gain of the amplifier 45 is a minimum (substantially zero). The output of the microphone 33 led out from the amplifier 45 may be considered to be substantially zero. The resistance value of the variable resistor VR3 is a maximum, and the gain of an amplifier 47 is 1 (unity). On the contrary, the resistance value of the variable resistor VR4 is a minimum, and the gain of an amplifier 48 is substantially zero. Accordingly, the output of the buffer amplifier 46 is derived from an output terminal 50 through amplifiers 47 and 49.

Figure 5:
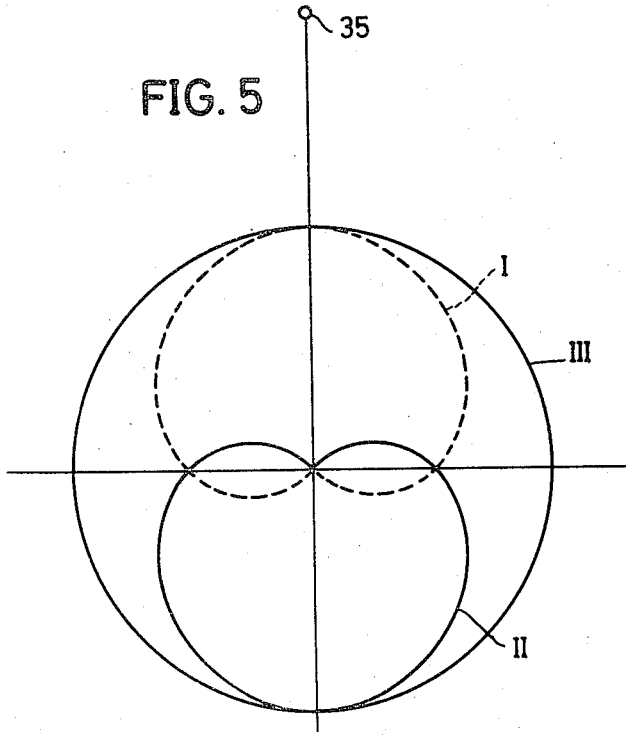
FIG. 5 is a graphical diagram for an explanation of the principle of the directivity of the variable-directivity microphone device of the invention; p

Here, the directivity pattern of the microphone unit 31 of the configuration shown in FIG. 2 is as indicated by curve I in FIG. 5, while the directivity pattern of the microphone unit 33 is as indicated by curve II in FIG. 5. Therefore, in the case where the outputs of the microphone units 31 and 33 are mixed with the same level, the combined directivity pattern resulting from the combination of the microphone units 31 and 33 becomes as indicated by curve III in FIG. 5.

The angle between the centerline respectively of the microphone units 31 and 33 and the sound source 35 will be denoted by $\theta$, and the ratio B/A of the gain B of the amplifier amplifying the output of the microphone 32 and the gain A of the amplifier amplifying the output of the microphone 31 will be denoted by $\alpha$. Then the directivity pattern P obtained as a result of combining the outputs of the microphone units 31 and 33 is expressed by the following equation.

$$P = \frac{1 + \cos\theta}{2} + \alpha \frac{1 + \cos(\theta - \pi)}{2}$$

In the case where the slider of the variable resistor VR1 is at the position ①, the gain of the amplifier 44 is 1 (unity) as indicated in FIG. 6(A), and $\alpha$ may be considered to be 1 (unity). The directivity pattern P① at this time is expressed by the following equation.

$$P_{①} = \frac{1 + \cos\theta}{2} + \frac{1 - \cos\theta}{2} = 1$$

Accordingly, in the state prior to zooming control operation, the directivity of the microphone device is a non-directional one.

Then, the case wherein zooming up is carried out, and the sliders of the variable resistors VR1 through VR5 are slidingly displaced from their respective positions ① to their respective positions ② will be considered. As indicated in FIG. 6(A), the resistance value of the variable resistor VR1 decreases as its slider undergoes sliding displacement from the position ① toward the position ②, and, when the slider reaches the position ②, the gain of the amplifier 44 becomes substantially zero. Accordingly, $\alpha$ may be considered to be zero, and the directivity pattern $P_{②}$ at this time is given by the following equation.

$$P_{②} = \frac{1 + \cos\theta}{2}$$

Therefore, in the state wherein zooming up has been carried out to a degree corresponding to the arrival of the sliders of the variable resistor VR1 through VR5 at their respective positions ②, the directivity of the microphone device becomes a primary unidirectivity.

Figure 6:
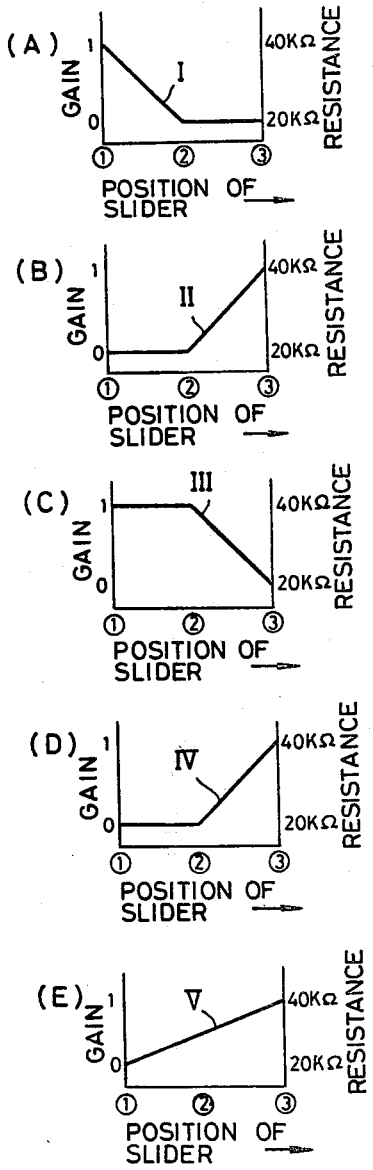
FIGS. 6(A) through 6(E) are graphs respectively indicating variations in the resistance values of variable resistors and the gains of amplifiers in the circuit shown in FIG. 4.

During the period wherein the sliders of the variable resistors VR1 through VR5 undergo sliding displacement from their respective positions ① to their positions ②, the resistance value of the variable resistor VR3 remains at its maximum value and does not vary, and the gain of the amplifier 47 remains unchanged at its maximum value (unity), as shown in FIG. 6 (C). At this time, furthermore, as indicated in FIGS. 6(B) and 6(D), the resistance values of the variable resistors VR2 and VR4 remain unchanged at their minimum values, and the gains of the amplifiers 45 and 48 remain unchanged at their minimum values (substantially zero). Accordingly, the outputs of the amplifiers 45 and 48 are substantially zero.

The output of the microphone unit 31 which has passed through the preamplifier 41 and the output of the microphone unit 32 which has passed through the preamplifier 42 and the amplifier 44 are combined and supplied to the buffer amplifier 46. The resulting output of the buffer amplifier 46, after being amplified by the amplifier 47, is amplified by the sound volume amplifier 49 whose gain undergoes variation continuously in responsive conformity with the displacement of the slider as indicated in FIG. 6(E), and the resulting output is led out through an output terminal 50.

Figure 7:
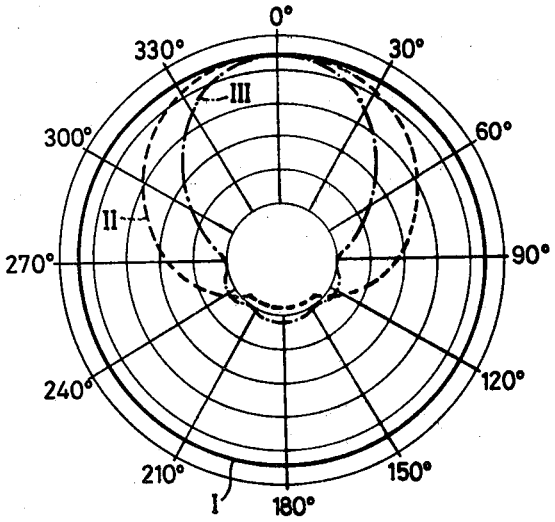
FIG. 7 is graphical diagram for a description of the seconary unidirectivity of the microphones shown in FIG. 2.

A directivity pattern actually obtained by the above described microphone device is shown in FIG. 7. In FIG. 7, the angular values represent angles in the clockwise direction between the centerline of the microphone device and the sound source. FIG. 7 shows the directivity pattern with respect to a frequency of the sound from the sound source 35 of 1 KHz. In the case where, prior to zooming up, the sliders of the variable resistors VR1 through VR5 are at their respective positions ①, a directivity pattern of non-directivity as indicated by curve I in FIG. 7 is obtained. In the case where the sliders of these variable resistors VR1 through VR5 are at their respective positions ②, the directivity pattern becomes as indicated by curve II. In response to the zooming control operation, the sliders of the variable resistors VR1 through VR5 are slidingly displaced from their respective positions ① to their positions ②, and, accordingly, the directivity pattern of the microphone device varies progressively from that of the curve I to that of the curve II, the directivity becoming sharp.

Next, the case wherein zooming up is carried out further, and the sliders of the variable resistors VR1 through VR5 have undergone sliding displacement from their respective positions ② to their positions ③ will be considered. When the slider of the variable resistor VR1 has moved from the position ② to the position ③, the gain of the amplifier 44 is substantially zero as indicated in FIG. 6(A), and its output is substantially zero. On the other hand, as the slider of the variable resistor VR2 moves from the position ② to the position ③, the gain of the amplifier 45 becomes progressively high as indicated in FIG. 6(B). Accordingly, at this time, the output of the microphone unit 31 which has passed through the preamplifier 41 and the output of the microphone unit 32 which has passed through the preamplifier 43 and the amplifier 45 are combined and supplied to the buffer amplifier 46.

Here, the preamplifiers 41 and 43 have respectively circuit constructions for producing the amplified signals of which phases are inverted with each other. Accordingly, the output signal of the microphone unit 31 passed through the preamplifier 41 and the output signal of the microphone unit 32 passed through the preamplifier 43 and the amplifier 45 are subtracted with each other when they are mixed.

The angle between the centerline l of the microphone units 31 and 32 and the sound source 35 will be denoted by $\theta$, the gain of the amplifier with respect to the output of the microphone unit 31 by A, the gain of the amplifier with respect to the output of the microphone unit 32 by C, the ratio (wavelength constant) $\omega/V$ of the angular velocity $\omega$ and the velocity V of sound K, and the distance between the diaphragms of the microphone unit 31 and 32 by D. Then, the directivity pattern of the microphone device obtained by subtracting the output of the microphone unit 32 from the output of the microphone unit 31 (by combining the outputs of the microphone units 31 and 32 with mutually opposite phase) is expressed by the following equation.

$$P = A \cdot e^{j\omega t} \cdot \frac{1 + \cos\theta}{2} - C \cdot e^{j(\omega t + KD\cos\theta)} \cdot \frac{1 + \cos\theta}{2}$$

When, in the above equation, frequency is made a parameter, and $\theta$ is considered to be a variable, the directivity pattern at the time when the sliders of all variable resistors are at their respective positions ③ is expressed by the following equation.

$$P_{③} = M(1 + \cos\theta)\{1 - \cos\theta(kD\cos\theta)\}$$

In the above equation, M is a constant arising from the modification of the equation.

Figure 8:
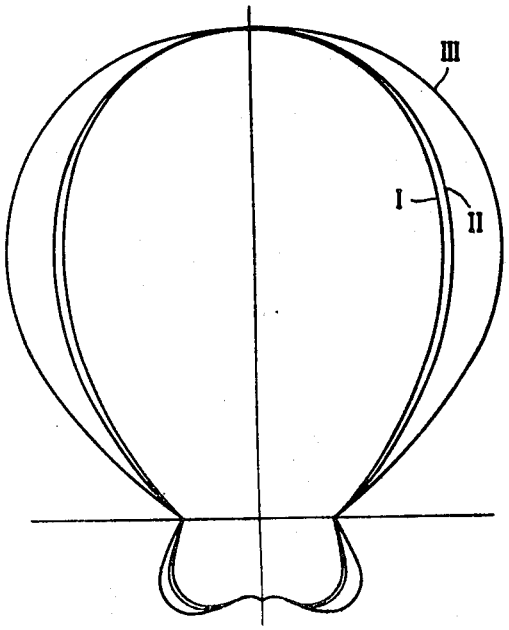
FIG. 8 is a graph indicating the secondary unidirectivity obtained by the microphone device.
Figure 9:
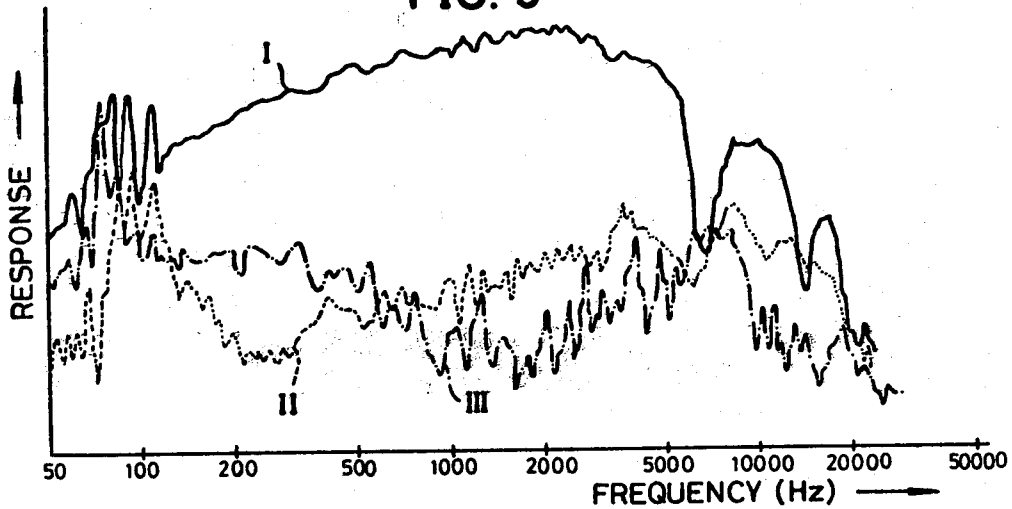
FIG. 9 is a graph indicating a frequency characteristic of the secondary unidirectivity obtained by the microphone device.

In the above equation, the directive characteristics with a range of the order of $kD \leqq 3$ become as indicated in FIG. 8. In FIG. 8, curves I, II, and III indicate the directivity pattern for 1 KHz, 2 KHz, and 4 KHz, respectively. Furthermore, their frequency response characteristics become as indicated in FIG. 9, in which curves I, II, and III indicate the characteristics respectively for the cases wherein the angle formed relative to the sound source is 0°, 90°, and 180°. A directivity of this character is called a secondary sound-pressure gradient unidirectivity (hereinafter referred to as secondary unidirectivity). In the case where the distance coefficient for non-directivity is made equal to 1 (unity), in contrast to its value of 1.73 in the case of primary unidirectivity, that in the case of secondary unidirectivity becomes 2.81, and the directivity of the secondary unidirectivity is even more sharper than the primary unidirectivity.

During this period of sliding displacement of the sliders of the variable resistors VR1 through VR5 from their respective positions ② to their positions ③, the gain of the amplifier 47 decreases as indicated in FIG. 6(C), while the gain of the amplifier 48 increases as indicated in FIG. 6(D).

The combined output signals of the microphone units 31 and 32 supplied to the buffer amplifier 46 as described above are amplified thereby and supplied to the amplifiers 47 and 48. The resulting output of the amplifier 48 is frequency-compensated by an equalizer circuit 51 comprising resistors and capacitor and is thereafter combined with the output of the amplifier 47, the combined outputs being supplied to the amplifier 49. The resulting amplified output of the amplifier 49 is led out through the output terminal 50. At the time of mixing of the outputs of the microphone units 31 and 32, the low frequency characteristic is deteriorated with a proportion of 6 dB/oct when the ratio of the two output levels is 1:1. For this reason, the above mentioned frequency compensation is carried out in the equalizer 51 thereby to flatten the frequency characteristics.

In the case where the directivity is to be varied from non-directivity to primary unidirectivity, there is no necessity of compensation of the frequency characteristic. For this reason, the gain of the amplifier 48 is substantially zero during the sliding displacement of the slider of the variable resistor VR4 from its position ① to its position ②. Furthermore, in the case where the directivity is to be varied from primary unidirectivity to secondary unidirectivity, the gain of the amplifier 47 gradually decreases, whereas the gain of the amplifier 48 gradually increases.

The secondary unidirectivity pattern (for a frequency of 1 KHz) actually obtained when the sliders of all variable resistors are at their respective positions ③ is as indicated by curve III in FIG. 7. As the sliders of all variable resistors undergo sliding displacement from their respective positions ② to their positions ③ in response to zooming control operation, the directivity pattern varies from curve II to curve III, and the directivity becomes sharp.

As described above, at the time of zooming up, the directivity of the microphone device becomes sharp. For this reason, reflected sounds and sounds angularly separated from the object image being picked up and coming form directions unrelated thereto are not collected, and direct sounds from the object image are picked up. Accordingly, sound collection is accomplished in a state highly appropriate for the zoomed up picture.

In this manner, in accompaniment with the zooming operation of a picture by the zoom lens system, the acoustic image also can be zoomed, whereby the sense of natural unity between the optical image and the acoustic image can be imparted. Moreover, since the directivity varies greatly during this operation, acoustic image zooming can be accomplished as an ample sense of distance is imparted.

Furthermore, by providing a suitable number of microphone units other than the above described microphone units 31, 32, and 33, and accordingly supplementing components such as variable resistors and amplifiers in the circuit shown in FIG. 4, a tertiary or higher-order unidirectivity can be obtained. In actual practice, however, a unidirectivity up to secondary unidirectivity is amply sufficient.

Figure 10A:
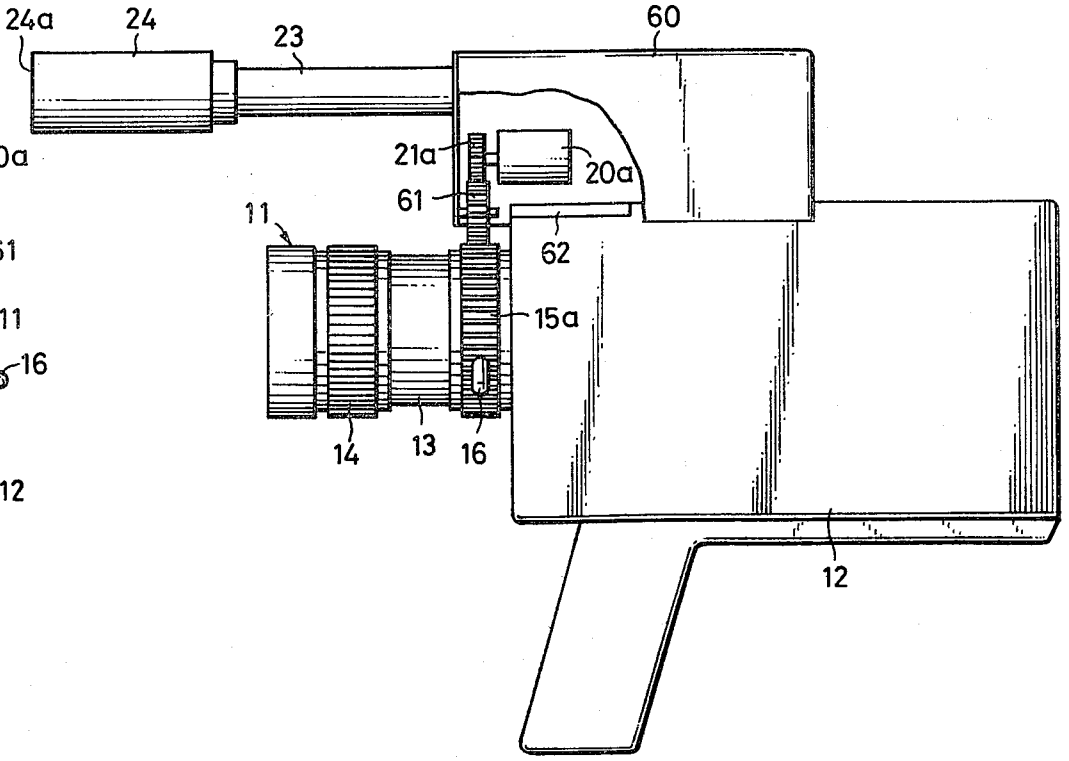
FIGS. 10A and 10B are respectively a side view, with parts cut away, and a front view of another example of a television camera in which the variable-directivity microphone device according to the invention is applied.
Figure 10B:
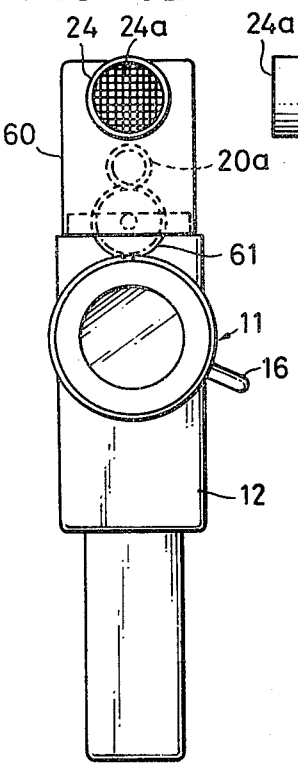

Another embodiment of a television camera in which the variable-directivity microphone device of the present invention is combined will now be described in conjunction with FIGS. 10A and 10B. In these figures, those parts which are the same as corresponding parts in FIGS. 1A and 1B are disignated by like reference numerals. Description of such parts will not be repeated.

A zoom ring 15*a* in this camera is provided with gear teeth around its periphery. A variable resistor 20*a* is accommodated within a housing 60. A gear 21*a* fixedly mounted on the rotating shaft of this variable resistor 20*a* is meshed with an idler gear 61 rotatably supported on the housing 60. The housing 60 is detachably mounted via an attachment shoe 62 to the upper part of the camera body 12. When the housing 60 is in mounted state on the camera body 12, the gear 61 is meshed with the above mentioned gear provided around the periphery of the zoom ring 15*a*. The circuit shown in FIG. 4 including the variable resistor 20*a* (variable resistors VR1 through VR5) is accommodated within the housing 60.

Since the housing 60 is detachably mounted on the camera body 12, when there is no necessity of picking up sounds by means of the microphones, the housing 60 can be detached to permit the use of only the camera. Furthermore, the lower part of the gear 61 is projecting downward through and beyond the lower surface of the housing 60. For this reason, in the case where the microphone device is to be operated separately from the camera, the housing 60 is detached from the camera body 12, and then, by rotating by finger the gear 61 projecting from the lower surface of the housing, the directivity of the microphone device can be varied separately from and independently of the camera.

It will be apparent that various modifications in the construction and arrangemment of the above described variable-directivity microphone device can be made without departing from the intended scope of the present invention.

For example, instead of using gears such as the above described gears 17, 19, 21, 21*a*, and 61 and the gear of the zoom ring 15*a*, rotating members provided with peripheral materials, such as rubber, of large coefficient of friction may be used to transmit rotation by friction force.

Figure 11:
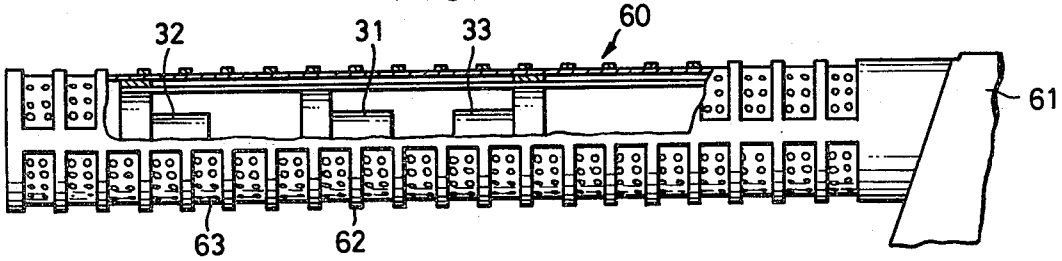
FIG. 11 is a side view, with parts cut away, of one embodiment of a microphone unit assembly.

One embodiment of the microphone unit assembly according to the invention is shown in FIG. 11. In the arrangement illustrated in FIG. 2, the centerline of the microphone unit 33 is not coincident with the centerlines of the other microphone units, but this is not necessary in all cases. In the arrangement shown in FIG. 11, the three microphone units 31, 32, and 33 are accommodated within the housing 60 with a configuration such that the centerlines of the forward facing microphone units 31 and 32 and the rearward facing microphone unit 33 respectively lie in a single line. The housing 60 is fixed to, for example, a handle 61 provided at the upper part of the camera body. The housing 60 comprises a frame structure 62 having a plurality of openings and punching metals 63 provided on the peripheral surfaces and the front surface of the housing.

As another example, the variable resistor 20 (variable resistors VR1 through VR5) may be of the type having rotating sliders, as in the above described embodiments of the invention, or they may be of the type having sliders which vary resistance when moved translationally.

Furthermore, the variable-directivity microphone device according to the present invention is applicable not only to a television camera but also to other zooming means such as, for example, the zoom lens system of an 8-mm, 16-mm, or 35-mm film cinecamera. The microphone device of the invention may be adapted to be used independently as a microphone device without being combined with a camera or the like.

Further, this invention is not limited to these embodiment but various variations and modifications may be made without departing from the scope of the invention.

What we claim is:

1. A variable-directivity microphone device comprising:

a microphone unit assembly of at least three microphone units, said three microphone units comprising first and second microphone units mutually spaced apart by specific distances and disposed with the front faces thereof facing the front face of said microphone unit assembly and a third microphone unit disposed with the front face thereof facing in the opposite direction relative to the direction of the front faces of said first and second microphone units;

directivity varying control means capable of undergoing displacement between at least three positions;

first mixing quantity varying means operating, while said control means is between a first position and a second position, to mix in accordance with the position thereof the output signal of the third microphone unit with the output signal of the first microphone unit with varied mixing quantity and, while said control means is between the second position and a third position, to cause the mixing quantity of the output signal of said third microphone unit to be zero; and second mixing quantity varying means operating, while said control means is between said second position and said third position, to mix in accordance with the position thereof the output signal of the second microphone unit with the output signal of said first microphone unit with varied mixing quantity and, while said control means is between said first and second positions, to cause the mixing quantity of the output signal of said second microphone unit to be zero, the directivity of said microphone device obtained from the output signals of the first and third microphone units mixed through said first mixing quantity varying means in accordance with the displacement of said control means between the first and second positions being varied between a state of non-directivity and a primary sound-pressure gradient unidirectivity, the directivity of said microphone device obtained from the output signals of the first and second microphone units mixed through said second mixing quantity varying means in accordance with the displacement of said control means between the second and third positions being varied between the primary sound-pressure gradient unidirectivity and a multiple-order sound-pressure gradient unidirectivity.

2. A variable-directivity microphone device as claimed in claim 1 in which said first and second mixing quantity varying means respectively have first and second variable resistors interrelatedly varied by said control means, and first and second amplifiers connected to the first and second variable resistors, the gains of the first and second amplifiers being varied responsive to the resistance values of the first and second variable resistors, the directivity of the microphone device being varied between a primary sound-pressure gradient unidirectivity and secondary sound-pressure gradient unidirectivity while the control means is between the second and third positions.

3. A variable-directivity microphone device as claimed in claim 1 in which the resistance values of said first and second variable resistors are changed such that the gain of the first amplifier is reduced from 1 (unity) to zero while the gain of the second amplifier is maintained to be zero in response to displacement of the control means from the first position to the second position, and the gain of the first amplifier is maintained to be zero while the gain of the second amplifier is increased from zero to 1 (unity) in resonse to displacement of the control means from the second position to the third position.

4. A variable-directivity microphone device as claimed in claim 2 which further comprises first and second signal paths which are connected in parallel and supplied with the mixed output signals of the first and third microphone units the mixed output signals of the first and second microphone units respectively mixed by the first and second mixing quantity varying means, and means for mixing the signals passed through the first and second signal paths and deriving the mixed signals.

said first and second signal paths comprising respectively third and fourth variable resistors of which resistances are changed in interlocking with the first and second variable resistors in response to the control means and respectively third and fourth amplifiers connected to the third and fourth variable resistors, the gains of the third and fourth amplifiers being changed in response to the resistance values of the third and fourth variable resistors, said second signal path further comprising an equalizer for compensating deteriorations of the frequency characteristic of low frequency range, the resistance values of said third and fourth variable resistors being changed such that the gain of the third amplifier is maintained to be 1 (unity) while the gain of the fourth amplifier is maintained to be zero in response to displacement of the control means from the first position to the second position, and the gain of the third amplifier is decreased while the gain of the fourth amplifier is increased in response to displacement of the control means from the second position to the third position.

5. A variable-directivity microphone device as claimed in claim 4 which further comprises a fifth variable resistor of which resistance is changed in interlocking with the first through fourth variable resistors and a fifth amplifier connected to the fifth variable resistor, the gain of the fifth variable resistor, the gain of the fifth amplifier being changed in response to the resistance value of the fifth variable resistor, the resistance value of the fifth variable resistor being changed such that the gain of the fifth amplifier increases in response to the displacement of the control means from the first position to the third position.

6. A variable-directivity microphone device as claimed in claim 1 which is mounted to a camera including a zoom lens system having a zoom ring for zooming responsive to rotation thereof, and in which said control means comprising said zoom ring and means for controlling said first and second mixing quantity varying means responsive to the rotation of the zoom ring.

7. A variable-directivity microphone device as claimed in claim 1 which further comprises a cylindrical housing having sound passing parts at the front and peripheral surfaces thereof, and in which said first, second, and third microphone units are accommodated and held in the cylindrical housing such that the center lines of the first, second, and third microphone units are on one line.

* * * * *